US005860528A

United States Patent [19]

Emery

[11] Patent Number: 5,860,528

[45] Date of Patent: Jan. 19, 1999

[54] HINGED CONTAINER WITH SEPARATELY MOULDED COVER AND TRAY

[76] Inventor: Roy William Emery, 1 Donino Court, Toronto, Ontario, Canada, M4N 2H6

[21] Appl. No.: 818,772

[22] Filed: Mar. 14, 1997

[51] Int. Cl.[6] ..... B65D 85/32

[52] U.S. Cl. ..... 206/521.1; 206/521.6; 220/337

[58] Field of Search ..... 206/521, 521.1, 206/521.15, 521.2–521.9, 815; 220/337, 338

[56] References Cited

U.S. PATENT DOCUMENTS

| | | | |
|---|---|---|---|
| 3,095,965 | 7/1963 | Stahl et al. | 220/337 |
| 3,568,914 | 3/1971 | Ahlmeyer | 206/521.1 |
| 3,570,747 | 3/1971 | McKenna | 206/521.1 |
| 3,968,921 | 7/1976 | Jewell | 220/337 |
| 4,216,862 | 8/1980 | Daenen | 220/337 |
| 4,401,312 | 8/1983 | Parker | 220/337 |
| 4,625,908 | 12/1986 | Emery . | |
| 4,742,953 | 5/1988 | Jacobs et al. | 206/521.1 |
| 4,782,995 | 11/1988 | Emery et al. | 206/521.1 |

*Primary Examiner*—Paul T. Sewell
*Assistant Examiner*—Luan K. Bui
*Attorney, Agent, or Firm*—Marshall, O'Toole, Gerstein, Murray & Borun

[57] ABSTRACT

A moulded container with a detachable hinged cover, and a method of applying the cover into hinging engagement with the remainder of said container.

7 Claims, 9 Drawing Sheets

HINGED CONTAINER WITH SEPARATELY MOULDED COVER AND TRAY

FIELD OF THE INVENTION

This invention relates to a hinged container comprising a separately moulded cover and tray. The invention has application to the familiar folding egg carton which is the best known example of a moulded container with a hinged cover.

BACKGROUND OF THE INVENTION

There are a large number of U.S. patents covering details of the familiar folding egg carton, which embodies the concept of the subject container, but in which the cover is hinged along a fold line integrally moulded between the cover and the tray.

It is the object of this invention to create a container which avoids the requirement for a moulded fold line connecting the cover and the tray together. By eliminating also the traditional hinged locking flap according to the teaching of U.S. Pat. No. 4,625,908 awarded to Emery in 1986, the selection of the raw materials for manufacture of the container is not limited by the requirement for foldability at a hinge line. In accordance with this invention, the cover and tray may be separately manufactured and thereafter joined. This allows the moulding and printing of said cover, and the moulding and filling of the tray while said cover and said tray are still separated. The use of a container modified in this way is made practical by the provision, on line in the filling operation, of a simple and precise mechanism for fitting and closing the cover on the tray.

SUMMARY OF THE INVENTION

The essence of the invention lies in the provision of hinge parts on a separate cover for a container, and cooperating hinge parts on the tray of the container.

The cover has two side walls and a top wall which may have various perforations to expose to view the contents of the container. A first sidewall at the hinge side of the cover has a least two downwardly and outwardly extensions thereof, located to correspond with related hinge parts of the tray. A second and opposite side wall optionally has locking parts which cooperate with related locking parts on the tray.

In its simplest form the tray has a bottom wall, two end walls and two side walls, a first side and a second side, said first side being a hinge side and said second side being, optionally, a locking side.

In another embodiment of this invention the lower element of the container is a tray comprised of a plurality of cells to contain and protect individual fragile or delicate articles such as eggs or soft fruit. In this embodiment of this invention the cells are arranged in at least one row with at least three cells in each row, and are separated from each other by a series of posts which rise between them to at least the level of the outer rim of the tray.

In a preferred embodiment of this invention, the tray has two sides, a first side which is the hinge side extending along the outer margin of said at least one row of cells, and a second side which is optionally a locking side, and which extends along the outer margins of the other side of said at least one row of cells.

The hinge parts of the tray preferably comprise a hinging flange which extends along the hinge side of the tray at the upper rim thereof, and which extends outwardly and downwardly directed from said rim. The flange has at least two slots adjacent and parallel the rim of the tray.

In one embodiment of this invention, at least two posts rise along the hinge side of said tray and are each provided with an open front and a top wall to receive and retain in position the corresponding hinge parts of the cover while said cover is in the hinged open position.

Each of the hinge parts of the cover may have a locking projection on the outer face thereof which is designed to cooperate with a lip of said hinging flange of said tray when said cover is in the closed position to maintain the attachment together of the hinging parts of said cover and said tray while said cover is in the hinged open position, and also when said cover is in the closed position.

The preferred method of placing, closing and locking said cover upon said tray is begun during a brief pause in the conveyor transport of the tray, which has already been filled at a previous station on line. The equipment employed comprises a denesting unit, a mechanical transport and orientation unit, and a wheel or belt to accomplish final closure of the cover on each tray.

In operation, one of said covers is dropped from the denesting unit into a transport chamber, where it is securely retained in place by vacuum applied to the top wall of said cover by at least one vacuum cup while said cover is entered into full engagement between the hinging parts of said cover and the corresponding hinging parts of said tray.

Immediately thereafter the vacuum applied to the top wall of the cover is discontinued and replaced by a puff of compressed air applied through said at least one vacuum cup. This rotates the cover toward the closed position with the locking parts of the cover in gentle contact with, but not engaged with, the locking parts of the corresponding tray. The transport chamber is then rotated back into position under the denesting unit, ready to receive another cover to be placed on another tray.

Meantime the tray, already fitted with a cover, is transported on line by said conveyor to pass under a wheel or belt by means of which the cover is further rotated into the final locked position.

DETAILED DESCRIPTION OF PREFERRED EMBODIMENTS OF THE INVENTION

Figure 1A:
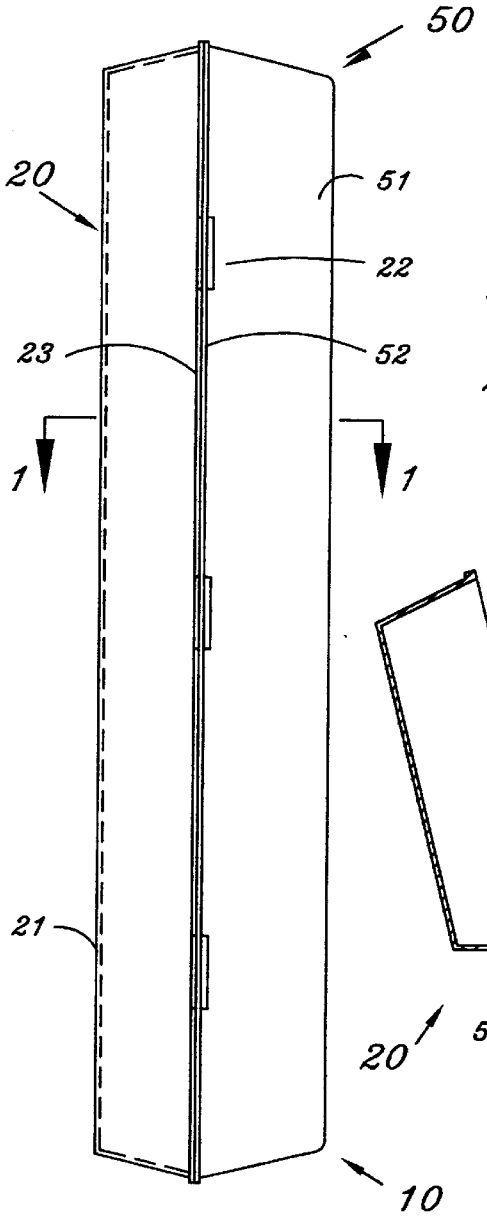
FIG. 1*a* is an elevation at the hinged side of a container, with a hinged cover made in accordance with this invention shown in a closed position on the container.

FIG. 1*a* is an elevational view at the hinge side of a container 10 with the cover 20 in a closed position on the tray 50, showing the hinging side of said container. The cover 20 in FIG. 2*a* and the tray 50 in FIG. 2*b* are shown separately in order to show details of the hinge parts which are hidden when the cover is in a closed position on the tray. The hinge parts of the cover are comprised of three downwardly and outwardly directed extensions 22 of the hinge side wall 21 of the cover. The hinge parts of the tray comprise a hinging flange 52 extending outwardly from the top margin of the hinge wall 51 of the tray. The flange has three slots 53 (FIGS. 1*c* and 2*b*) therein which extend parallel to the upper margin of the tray hinge wall.

Figure 1B:
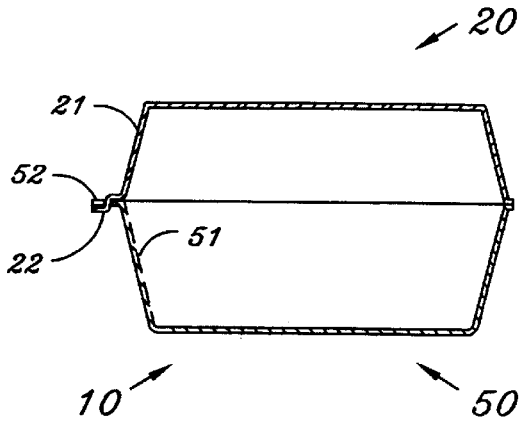
FIG. 1*b* is a cross sectional view of said container taken at line 1—1 of FIG. 1*a* with said cover in the closed position.

FIG. 1*b* is a cross sectional view at line 1—1 of FIG. 1*a* and shows the extensions 22 of said cover 20 engaged with the hinging flange 52 of said tray 50 while said cover 20 is in the closed position.

Figure 1C:
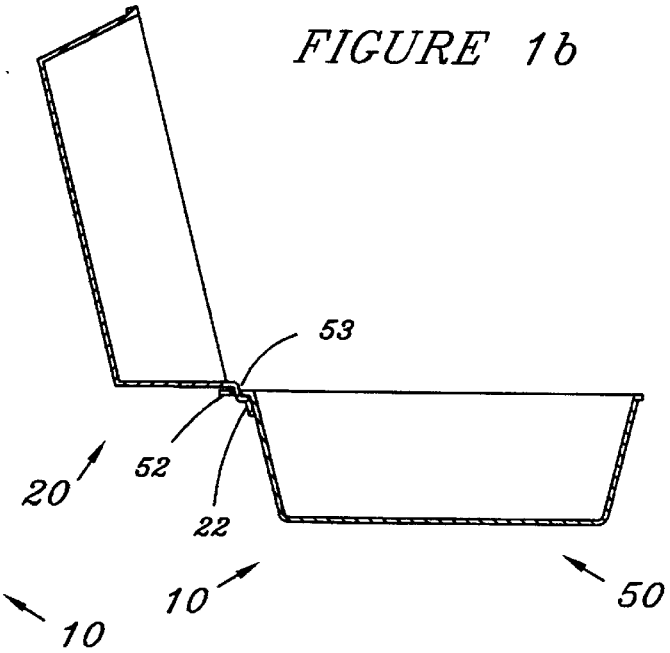
FIG. 1*c* is another cross sectional view of said container of FIG. 1*a* with said cover in a hinged open position.

FIG. 1*c* is another cross sectional view at line 1—1 of FIG. 1*a* and shows said cover 20 in the hinged open position, with the extensions 22 engaged with said hinging flange 52 through slots 53 (FIGS. 1*c* and 2*b*) thereof, and pressing against the underside of said flange 52 and the outer face of said side wall 51 in order to maintain said cover 20 in said open position.

Figures 3A, 3B, 3C:
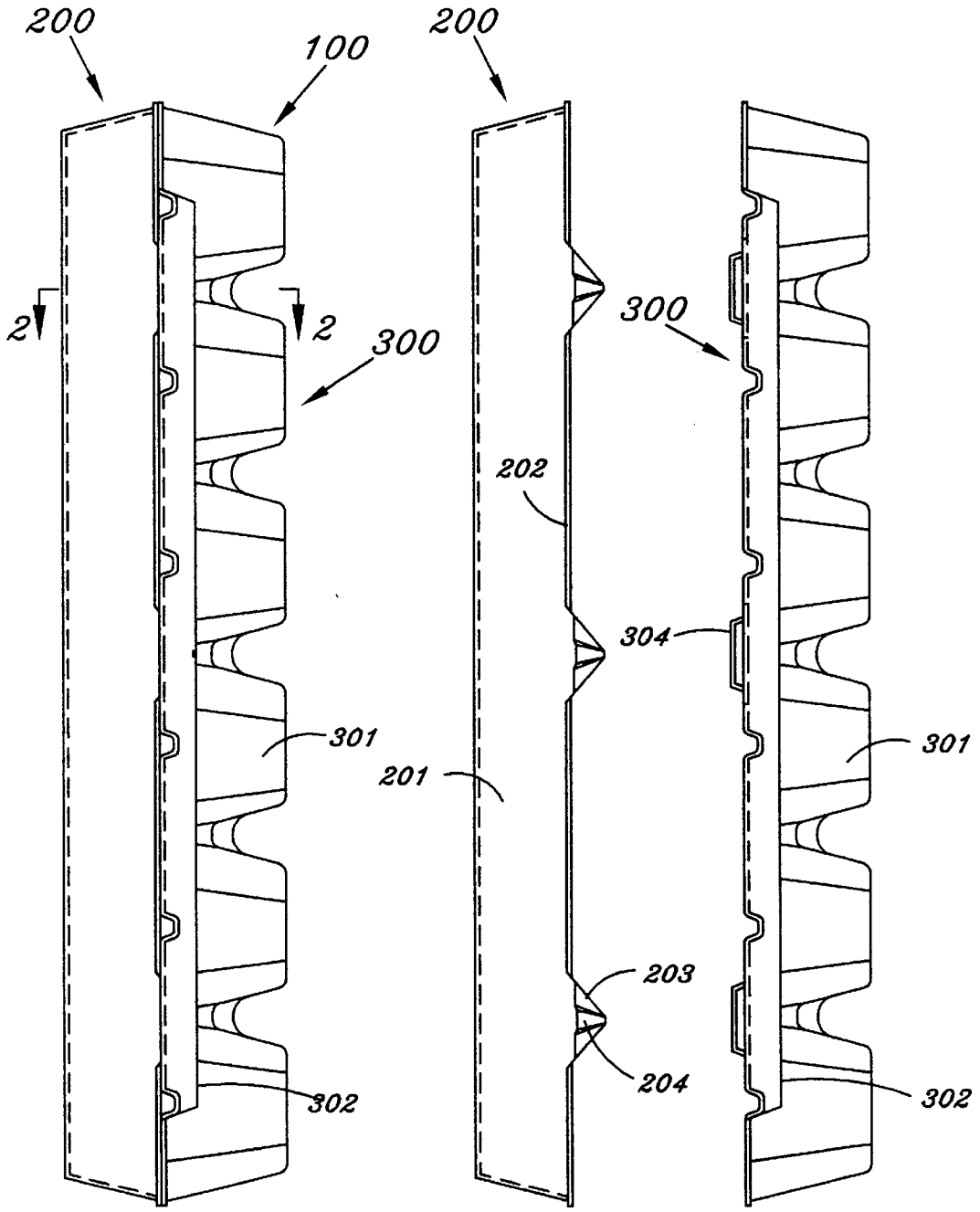
FIG. 3*a* is an elevation at the hinge side of an egg carton or similar container made in accordance with another aspect of this invention with a hinged cover in the closed position, and with a tray having protective cells.
FIG. 3*b* is an elevation of the hinge side of said cover detached from the remainder of said container of FIG. 3*a*.
FIG. 3*c* is an elevation of the hinge side of the separate tray of said container of FIG. 3*a*.

FIG. 3*a* is an elevational view of another example of a container 100 with a detachable cover 200 hinged to a tray 300 comprised of a plurality of cells 301 to contain and protect the fragile or delicate articles to be placed therein. The cover 200 in FIG. 3*b* and the tray 300 in FIG. 3*c* are shown separately in order to reveal a preferred number and location of hinging parts thereon. The hinge parts of said tray 300 are comprised of a hinging flange 302 with slots 303 (FIG. 4), and the upper parts of hinging posts 304, which are raised above the top surface of said hinging flange 302, the top walls of said posts 304 having an edge facing outwardly of said tray 300. The outward facing edge of the top wall of each hinging post 304 is aligned with an adjacent edge of the hinging flange 302 and forms an inner edge of the slot 303. The hinge parts of the cover comprise extensions 203 each with a locking prominence 204 moulded thereto.

Figure 4:
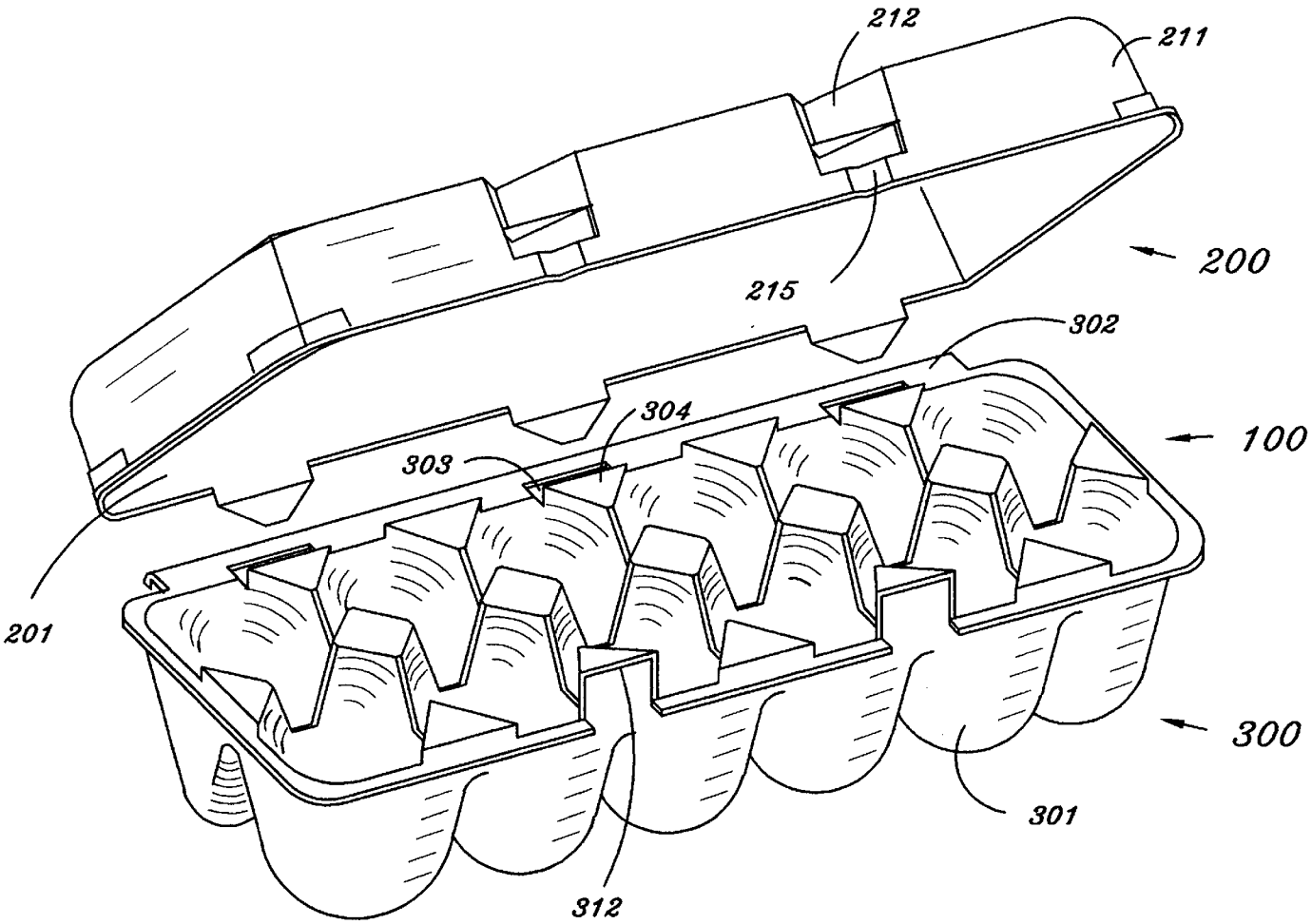
FIG. 4 is a perspective view of the folding egg carton of FIG. 3*a* showing the cover in ready position for engaging the hinge parts together.

FIG. 4 is a perspective view of said container 100 of FIG. 3*a*, showing the extensions 203 of said cover 200 in the ready position for engagement with the slots 303 of the tray 300. Also shown are the depressed channel walls 212 above openings 214 which are above locking parts 215 of the cover 200, and the corresponding locking posts 312 of the tray 300.

Figure 5A:
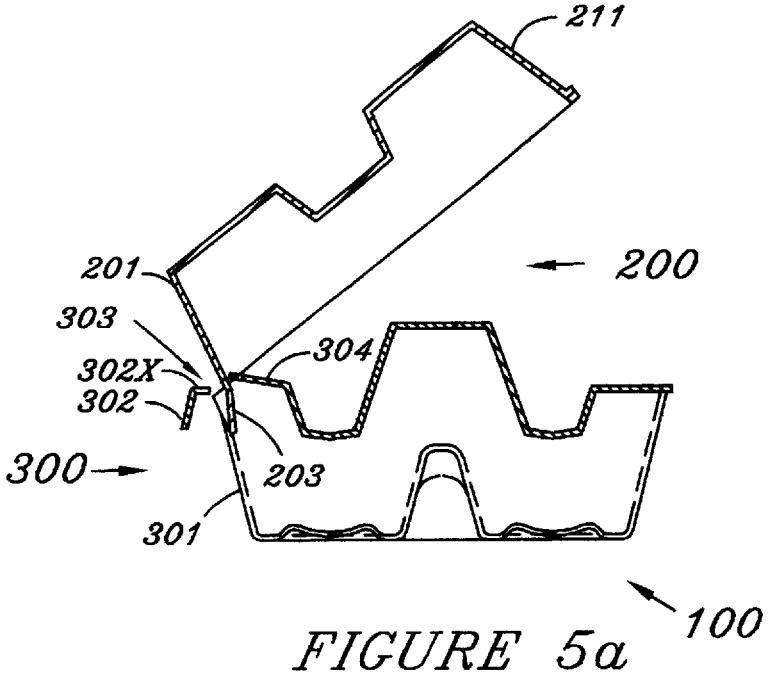
FIG. 5*a* is a cross section at line 2—2 of FIG. 3*a* but showing said cover in a partially open position.

FIG. 5*a* is a cross sectional view of said container 100 taken at line 2—3 of FIG. 3*a*, and shows said cover 200 located above said tray 300 at the predetermined angle for inserting said hinging extensions 300. The extensions approach the slots 303 at a predetermined angle to the plane of the slot opening, which allows them to pass freely through the slots.

Figure 5B:
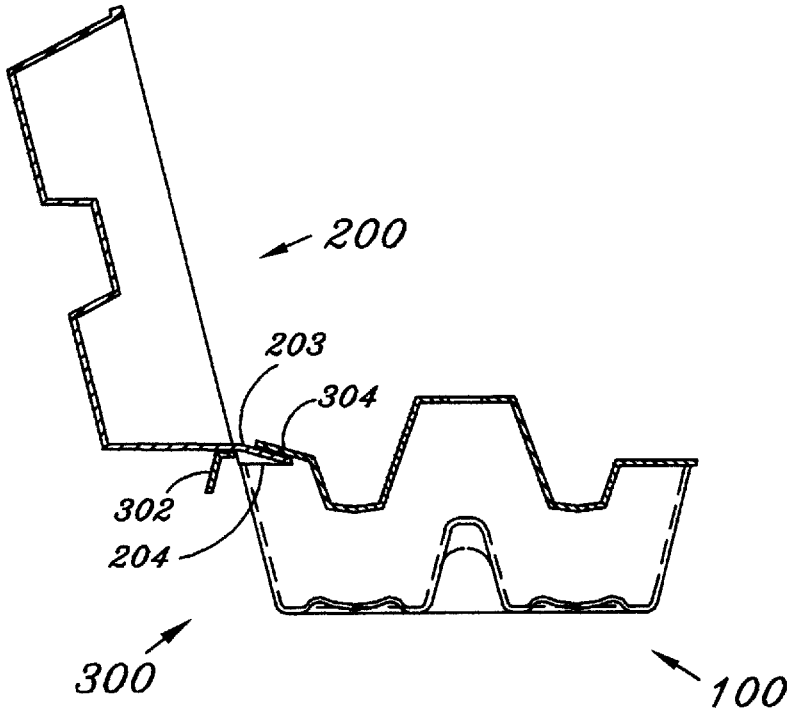
FIG. 5*b* is a cross section at line 2—2 of FIG. 3*a* but showing the cover in a fully open position on the tray.

FIG. 5*b* is also a cross sectional view of said container 100 taken at line 2—3 of FIG. 3*a* and shows said cover 200 in a folded open position with said tray 300 and with said hinging post 304, and also with said locking prominence 204 thereof in contact with the lip 302X of said hinging flange 302, thereby to maintain the attachment of said side wall 201 of said cover 200 to said tray 300.

Figure 2A:
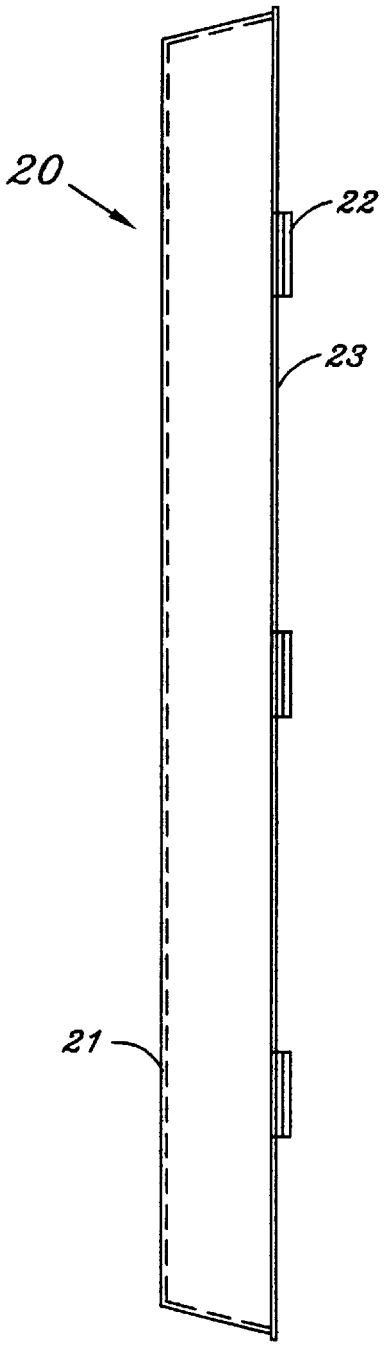
FIG. 2*a* is an elevation view of the hinge side of the cover detached from the tray.
Figure 2B:
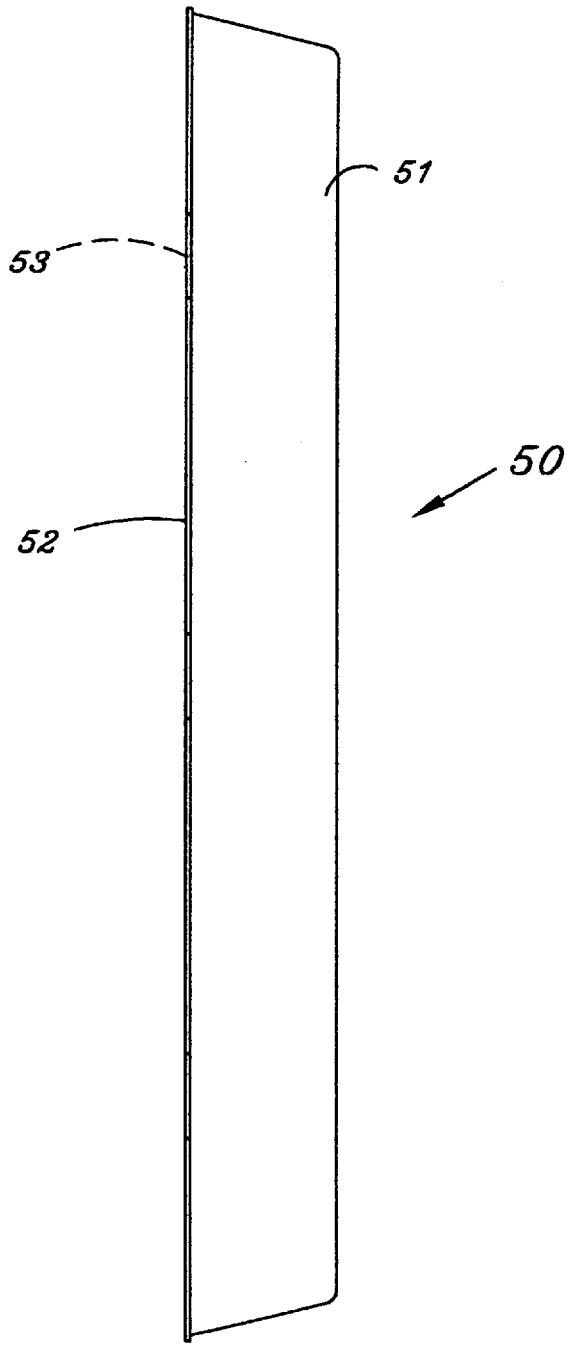
FIG. 2*b* is an elevation view of the hinge side of a separate tray.
Figure 6:
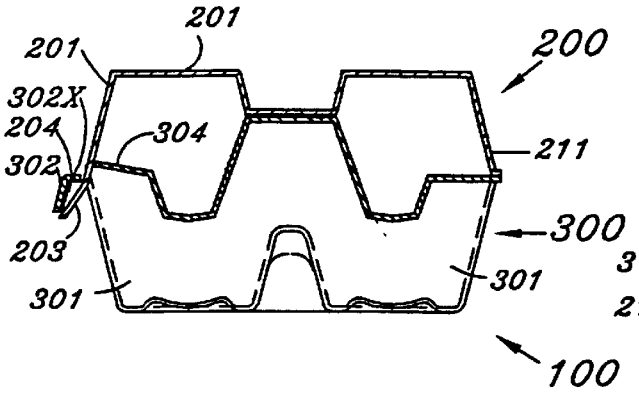
FIG. 6 is a cross section at line 2—2 of FIG. 3*a*.

FIG. 6 is a cross section through said container 100 at line 2—2 of FIG. 2*a* showing said cover 200 in fully closed position on said tray 300 with said locking prominence 204 of said hinging extension 203 in contact with said lip 302X of said hinging flange 302, thereby to maintain the attachment of said side wall 201 to said tray 300.

Figure 7:
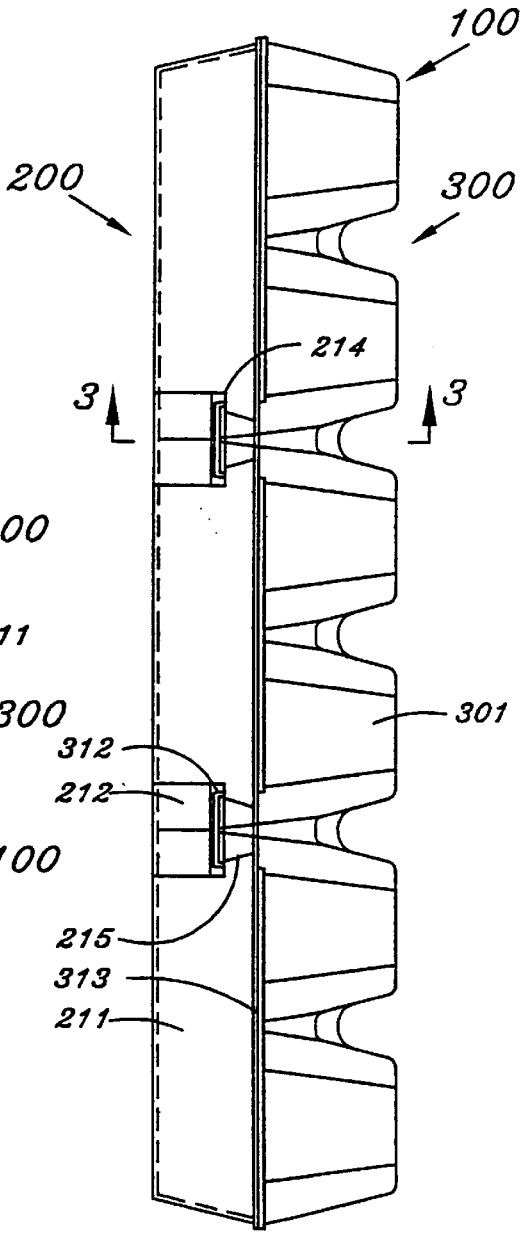
FIG. 7 is an elevation at the locking side of said container of FIG. 3*a* while said cover is in the closed and locked position.

FIG. 7 is an elevational view at the locking side of said container 100, with said cover 200 in the closed and locked position on said tray 300 of said container, and showing the top wall of said locking post 312 of said tray 300 in relation to the locking parts of side wall 211 of said cover 200, comprising said depressed channel walls 212, said locking part 215, and the opening 214.

Figure 8:
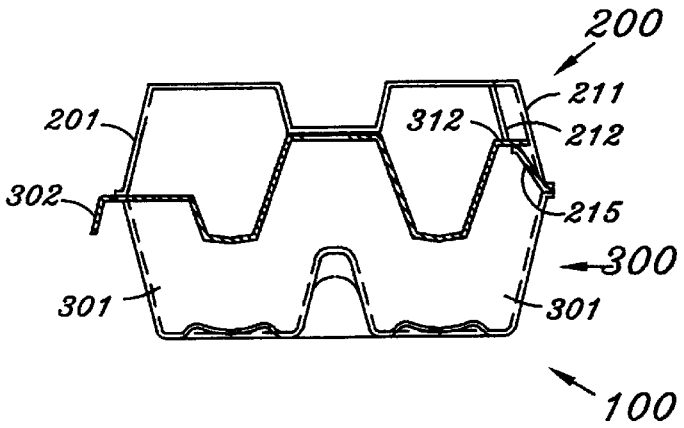
FIG. 8 is a cross section at line 3—3 of FIG. 7, showing the arrangement of the locking parts of said container when said cover is in the closed and locked position.

FIG. 8 is a cross section through said container 100 at line 3—3 of FIG. 7 to show the lower end of the depressed channel walls 212 at a locking side wall 211 of the cover 200 in supporting contact with the upper face of the top wall of locking post 312 of the tray 300. Also shown is a locking part 215 of said side wall 211 in locking position with the lower face of said top wall of said locking post 312, thereby to maintain said cover 200 securely in the closed position on said tray 300.

Figure 9:
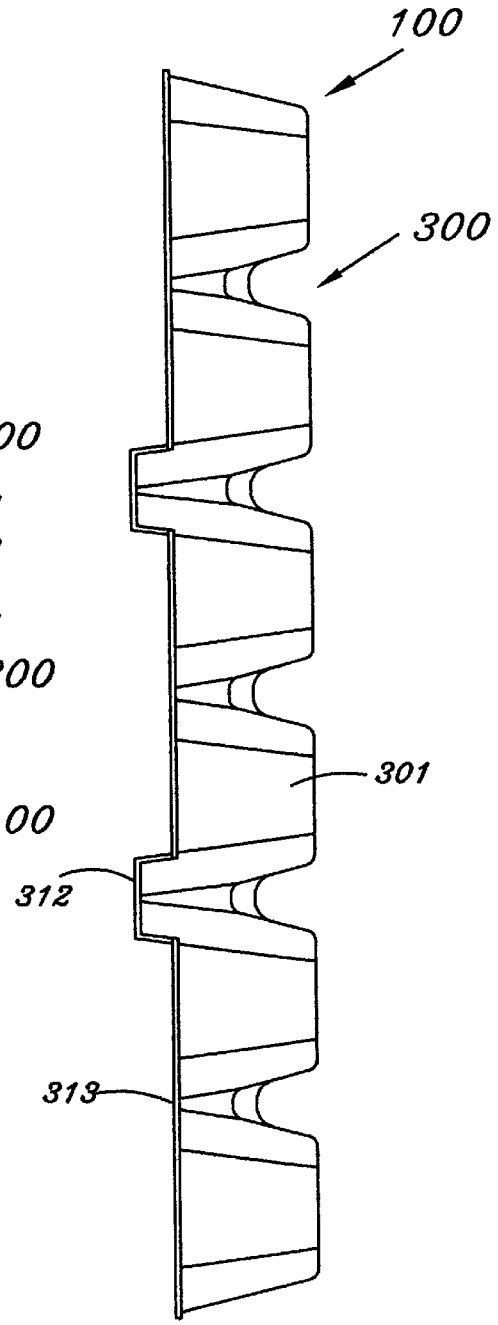
FIG. 9 is an elevation of the locking side of a separate tray.

FIG. 9 is an elevation at the locking side of said tray 300, showing the location of the two locking posts 312 and the open face thereof.

Figure 10:
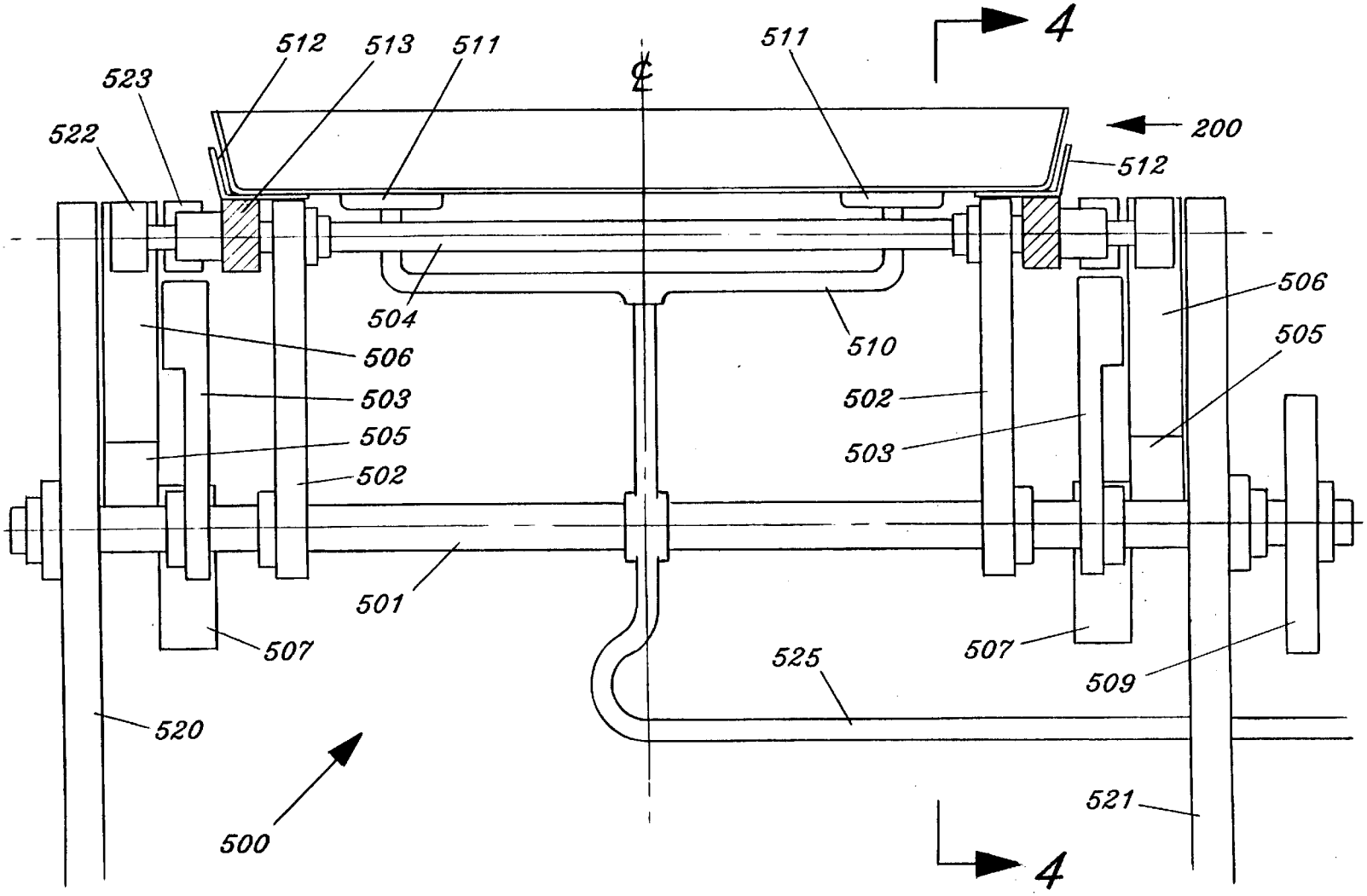
FIG. 10 is an elevational view showing said mechanism for transporting and orienting said separate cover of a container into hinging engagement with the rest of said cover.
Figure 11:
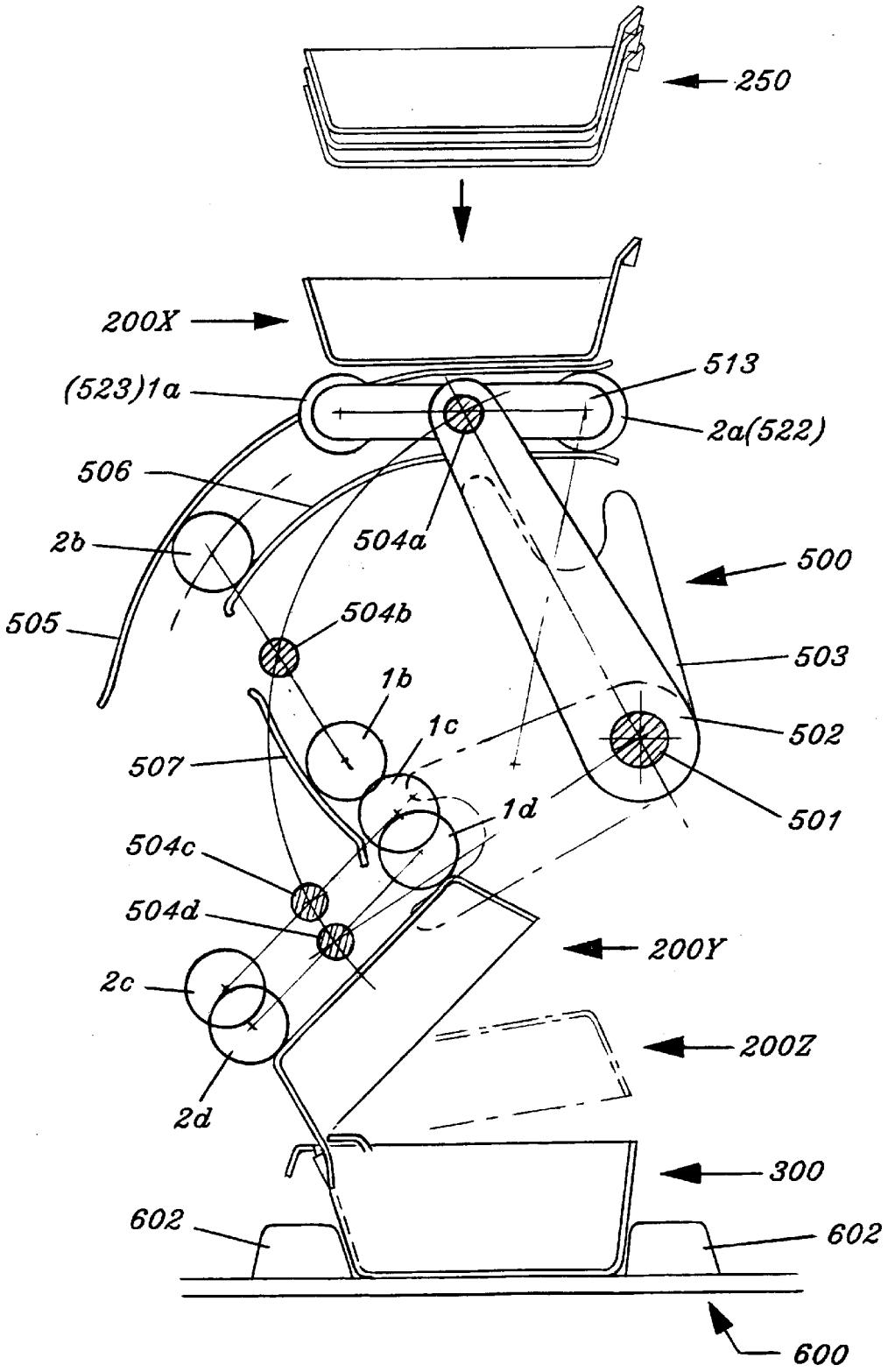
FIG. 11 is a cross sectional diagram taken at line 4—4 of FIG. 10 showing the elements of the mechanism used to transport and orient the separate hingeable cover of a container into hinging engagement with the rest of said container.

FIG. 11 is a diagrammatic cross sectional view taken at line 4—4 of FIG. 10. The figures show a mechanism 500 to receive the hingeable cover 200 of a container 100 delivered from a denesting unit 250 and transport and place said cover 200 in hinging engagement with the tray 300 of a container 100. The mechanism is comprised of:

a drive shaft 501, a transporting arm 502, a guide bar 503, a pivot shaft 504, a cam wheel support bar 513, cam follower wheels 522 and 523, and cam tracks 505, 506 and 507

FIG. 10 further shows a drive gear 509, side plates 520 and 521 which support the drive shaft 501 and the cam tracks 505, 506 and 507, the cover transporting cage 512, and a vacuum system including a vacuum supply hose 525, vacuum piping 510, and vacuum cups 511.

As seen in FIG. 10, mechanism 500 is positioning over a tray conveyor 600, having tray positioning lugs 602.

The pivot shaft 504 is transported through a circular path by the transporting arm 504 as shown at locations 504*a*,

504*b*, 504*c* and 504*d* of FIG. 11. The cam follower wheels 523 and 522 are guided in their travel by said cam tracks 505, 506 and 507 from the positions 522*a* and 523*a* into the positions 522*b* and 523*b*, and further guided into positions 522*c* and 523*c* and 522*d* and 523*d* by the guide bar 503, thereby to ensure that said cover 200 is maintained at the correct inclination with respect to said tray 300 during the period within which the extensions 203 of said cover 200 enter the slots 303 of said tray 300.

Not shown in this view are the details of said denesting unit 250 and the transporting chamber for the cover, which chamber is attached to said support bars 520. It is believed these details would be within the skill of one skilled in the art.

In sequence in the combined operation of said denesting unit 250, said mechanism 500, and said conveyor 600, one of said covers 200 is mechanically detached from said denesting unit 250, and drops therefrom into said transporting cage 512, where said cover is retained in position by the application of vacuum at the two vacuum cups 511 to the top wall of said cover during the time that said cover 200 is transported into the hinging position with said tray 300 with the hinging extensions of the cover inserted in the slots of the tray.

At a predetermined interval of time thereafter, said container 100 is transported by said conveyor 600 to pass under a wheel or belt by means of which said cover 200 is pressed down and rotated into a fully locked position on said tray 300.

I claim:

1. A hinged container comprised of a separately moulded tray and cover, said tray having a bottom wall, two end walls, a first side wall and a second side wall, said first side wall being a tray hinge wall having a hinging flange having at least two slots adjacent and parallel to the upper margin of said tray hinge wall; said hinging flange having at least two hinging posts, each formed as a depression in said tray hinge wall, with a top wall of each of said hinging posts rising above said hinging flange, each said hinging post top wall having an outwardly facing edge forming an edge of one of said slots; said cover having a top wall, two end walls, a first side wall and a second side wall, said first side wall being a cover hinge wall, with at least two outwardly and downwardly directed hinging extensions at its lower edge, said hinging extensions being at predetermined locations and tapered to a smaller width at their lower ends to facilitate their entry into said slots of said hinging flange of said tray, thereby to engage said hinging extensions of said cover with said slots of said hinging flange of said tray thereby to provide a hinging connection between said tray and said cover, each hinging extension having an outward extent sufficient to form a shoulder underneath said hinging flange at one side of a slot into which said hinging extension is received when said cover is in a closed position, and a downward extent sufficient to extend under said top wall of said hinging post when said cover is in an open position, each said hinging flange arranged so as to engage said tray under said top wall of said hinging post when said cover is in an open position, whereby to maintain said cover in said open position, each said hinging extension being configured to remain undeflected throughout travel between said open position and said closed position.

2. The hinged container of claim 1 wherein each said hinging extension has an enlarged base extending outwardly thereof tapering in width and thickness to a tip, said enlarged base defining said outwardly extending shoulder for extending under said hinging flange when said cover is in said closed position.

3. The container of claim 1 where said second wall of said cover has locking parts to engage with corresponding locking parts on said second side wall of said tray and thereby lock together said second wall of said cover to said second wall of said tray at their adjacent edges when said cover is in a closed position on said tray.

4. The container of claim 1 wherein said hinging posts comprise inwardly directed projections formed in the tray hinge wall.

5. The container of claim 4 where said tray is comprised of a plurality of protective cells to contain and separate articles contained therein from each other, said cells being arranged in at least one row of at least three cells in each row, all of said cells being integrally connected together and separated from each other by posts which rise between them, at least two of said posts serving as said hinging posts.

6. The container of claim 4, where said container is a folding egg carton with a detachable hinged cover.

7. The container of claim 4, where said tray of said container is comprised of a plurality of protective cells to contain and separate from each other fragile or delicate articles.

* * * * *